US012698147B2

(12) United States Patent
Toney et al.

(10) Patent No.: US 12,698,147 B2
(45) Date of Patent: Aug. 4, 2026

(54) PACKAGE OF RECLOSABLE BAGS WITH STAGGERED SLIDERS

(71) Applicant: REYNOLDS CONSUMER PRODUCTS LLC, Lake Forest, IL (US)

(72) Inventors: Kenneth A. Toney, Jacksonville, IL (US); John Wegner, Lake Forest, IL (US); Taylor Kizer, Chicago, IL (US); Brian Scaman, Jacksonville, IL (US)

(73) Assignee: REYNOLDS CONSUMER PRODUCTS LLC, Lake Forest, IL (US)

( * ) Notice: Subject to any disclaimer, the term of this patent is extended or adjusted under 35 U.S.C. 154(b) by 0 days.

(21) Appl. No.: 18/758,972

(22) Filed: Jun. 28, 2024

(65) Prior Publication Data

US 2025/0326563 A1 Oct. 23, 2025

Related U.S. Application Data

(60) Provisional application No. 63/635,890, filed on Apr. 18, 2024.

(51) Int. Cl.

| | |
|---|---|
| ***B65D 83/08*** | (2006.01) |
| ***B65B 5/06*** | (2006.01) |
| ***B65B 35/50*** | (2006.01) |
| ***B65B 63/04*** | (2006.01) |
| ***B65D 33/00*** | (2006.01) |
| ***B65D 33/25*** | (2006.01) |

(52) U.S. Cl.

CPC ..... *B65D 83/0805* (2013.01); *B65B 5/06* (2013.01); *B65B 35/50* (2013.01); *B65B 63/04* (2013.01); *B65D 33/002* (2013.01); *B65D 33/2508* (2013.01); *B65D 83/0894* (2013.01)

(58) Field of Classification Search

CPC ..... B65B 35/50; B65B 5/06; B65D 33/00; B65D 33/16; B65D 33/2589; A44B 19/16; A44B 19/26

USPC ..... 206/389

See application file for complete search history.

(56) References Cited

U.S. PATENT DOCUMENTS 4,274,573 A 6/1981 Finkelstein
4,581,006 A 4/1986 Hugues et al.
(Continued)

OTHER PUBLICATIONS

International Search Report and Written Opinion mailed Jun. 26, 2025 in International Application No. PCT/US2025/025173.

*Primary Examiner* — Anthony D Stashick
*Assistant Examiner* — Raven Collins
(74) *Attorney, Agent, or Firm* — Baker Botts L.L.P.

(57) ABSTRACT

A package of reclosable bags and method of packaging the same including a roll having a number x of reclosable bags each having opposite first, and second panels joined along corresponding first and second sides thereof and a mouth having a width defined therebetween. The mouth having a closure member along its width, and a slider for opening and closing the reclosable bag offset along the closure member relative to the slider of each adjacent reclosable bag in the roll. The roll of reclosable bags rolled about an axis parallel with the mouth of each bag and housed in a container having a plurality of walls defining a compartment. The container having a cross-sectional area linearly correlated with the number of reclosable bags in the roll defined by an equation of cross-section=m(x)+b.

18 Claims, 7 Drawing Sheets

(56) References Cited

U.S. PATENT DOCUMENTS

| | | | | |
|---|---|---|---|---|
| 4,611,728 | A | 9/1986 | Compton et al. | |
| 4,712,684 | A | 12/1987 | Boeckmann | |
| 4,979,617 | A * | 12/1990 | Benoit | A47K 10/3818 206/390 |
| 5,046,619 | A | 9/1991 | Hwang | |
| 5,682,730 | A | 11/1997 | Dobreski | |
| 5,823,933 | A | 10/1998 | Yeager | |
| 6,327,754 | B1 | 12/2001 | Belmont et al. | |
| 6,334,709 | B1 | 1/2002 | Bois | |
| 7,134,788 | B2 * | 11/2006 | Hsiang | B65D 33/14 383/9 |
| 7,168,561 | B2 * | 1/2007 | Dufresne | B65D 85/67 53/469 |
| 2006/0124490 | A1 | 6/2006 | Dufresne | |
| 2008/0175520 | A1 | 7/2008 | Simon | |
| 2011/0033138 | A1 | 2/2011 | Cameron et al. | |
| 2012/0138626 | A1 | 6/2012 | Haggerty et al. | |
| 2012/0279037 | A1 | 11/2012 | Thomas et al. | |
| 2012/0279981 | A1 | 11/2012 | Thomas et al. | |
| 2012/0317926 | A1 | 12/2012 | Collins | |

* cited by examiner

PACKAGE OF RECLOSABLE BAGS WITH STAGGERED SLIDERS

CROSS-REFERENCE TO RELATED APPLICATIONS

This application claims priority to U.S. Patent Application Ser. No. 63/635,890, filed Apr. 18, 2024, the content of which is hereby incorporated by reference in its entirety.

BACKGROUND

Field of the Disclosed Subject Matter

The disclosed subject matter generally relates to a roll of reclosable storage bags having staggered sliders for opening and closing the bags, and a container for dispensing said bags.

Description of Related Art

Reclosable storage bags are often used to store various types of articles and materials. These storage bags may be used to store food products, non-food consumer goods, medical supplies, and many other articles. Reclosable storage bags are convenient in that they can be closed and resealed after the initial opening to, for example, preserve the enclosed contents.

Resealable storage bags generally include a closure mechanism positioned along the mouth of the bag. The closure mechanism often comprises profile elements or closure profiles that engage one another when pressed together and disengage when pulled apart. Certain reclosable bags include a slider device that can be moved back and forth across the mouth of the package to open and close the closure mechanism. During the manufacturing process, the slider is attached to the closure mechanism on the resealable bag. For transport, storage, commercialization and dispensing, resealable bags are frequently stacked and rolled into a cylindric configuration, and the roll of resealable bags is then placed in a container. However, when the bags are stacked, the sliders of adjacent bags can align with one another and create an area of increased thickness such that when the stack of bags is rolled the roll can have a height greater on one side compared to the other. As a result, manufacturers of slider bags either reduce the number of storage bags in the container or use larger containers to accommodate the height of the side of the roll having the sliders, which can increase shipping and material costs.

It is therefore desirable to provide an improved means of arranging reclosable bags and increasing the packaging efficiency of a roll of bags within a container.

SUMMARY

The purpose and advantages of the disclosed subject matter will be set forth in and apparent from the description that follows, as well as will be learned by practice of the disclosed subject matter. Additional advantages of the disclosed subject matter will be realized and attained by the systems and methods particularly pointed out in the written description and claims hereof, as well as from the appended drawings.

To achieve these and other advantages, and in accordance with the purpose of the disclosed subject matter, as embodied and broadly described, the disclosed subject matter includes a roll of reclosable storage bags. The roll includes a number of x reclosable bags each having a first panel and a second panel opposite the first panel, the first panel and the second panel joined along corresponding first and second sides thereof with a mouth defined therebetween having a width less than about 9 inches. The reclosable bags further include a closure member extending along the mouth, the closure member including a slider configured to open and close the mouth. The roll is formed by rolling the reclosable bags about an axis parallel with the mouth of each bag, and the slider of each reclosable bag in the roll is offset along the closure member relative to the slider of each adjacent reclosable bag of the roll.

The disclosed subject matter further includes a container having a plurality of walls defining a compartment. The plurality of walls includes a bottom wall having a depth, a front wall having a height extending upwardly from the bottom wall, and a side wall having a height extending upwardly from the bottom wall and adjacent the front wall. The container has a cross-sectional area in side view defined in square inches. The cross-sectional area is linearly correlated with the number of reclosable bags in the roll defined by an equation of cross-section=m(x)+b, where m is about 0.17 and b is about 3.16.

The reclosable bags within the roll can be arranged in an overlapping shingled arrangement and staggered in a repeating pattern. Each slider has a slider length measured along the width of the mouth and can be offset along its respective closure member relative to the slider of each adjacent reclosable bag a distance greater than the slider length. For example, the roll can include a first reclosable bag, a second reclosable bag adjacent the first reclosable bag, and a third reclosable bag adjacent the second reclosable bag. The slider of the first reclosable bag can be spaced a first distance from the first side of the first reclosable bag, the slider of the second reclosable bag can be spaced a second distance from the first side of the second reclosable bag, and the slider of the third reclosable bag can be spaced a third distance from the first side of the third reclosable bag, the second distance being greater than the first distance by at least the slider length and the third distance being greater than the second distance by at least the slider length. The roll can further include a fourth reclosable bag adjacent the third reclosable bag, where the slider of the fourth reclosable bag is spaced a fourth distance from the first side of the fourth reclosable bag, the fourth distance being equal to the first distance, thereby creating a staggered repeating pattern. The first side of each reclosable bag of the roll can be aligned with the first side of the other reclosable bags of the roll. Additionally, or alternatively, the overall thickness each reclosable bag in the roll can be between 0.001 to 0.003 inches. The reclosable bags can be made of a material comprising polyethylene, silicone, polypropylene, and any other suitable blend of flexible resin material.

The container can also have a spatial efficiency defined by a second equation of $$\frac{X}{\text{the cross-sectional area}},$$

the spatial efficiency being measured in bags/unit cross-section value, with x being the number of bags in the roll. As embodied herein, when x is between 20 and 30 the spatial efficiency can be above 3, and when x is between 31 and 40 the spatial efficiency can be above 3.3. Additionally, or alternatively, the container can have an overall width at least equal to but less than 10% greater than the width of the mouth of each reclosable bag of the roll. The mouth of each reclosable bags can have a width between 7.5 and 8.5 inches. The number of bags x in a roll can be between 1 and 49.

In accordance with another aspect of the disclosed subject matter, the mouth of each reclosable bag can have a width greater than 9 inches and the cross-sectional area of the container can have a linear correlation to the number of reclosable bags in the roll defined by an equation of cross-section=m(x)+b, where m is about 0.26 and b is about 2.48, and where the cross-sectional area is in square inches. The container can also have a spatial efficiency defined by a second equation of $$\frac{X}{\text{the cross-sectional area}},$$

the spatial efficiency being measured in bags/unit cross-section value, with x being the number of bags in the roll. As embodied herein, when x is between 15 and 30 the spatial efficiency can be above 2.3, and when x is between 31 and 40 the spatial efficiency can be above 3. Additionally, or alternatively, the mouth of each reclosable bags can have a width between 9.5 and 11.5 inches.

In accordance with yet another aspect of the disclosed subject matter, a method of packaging the reclosable storage bags is provided. The method includes stacking a number x of reclosable bags, each of the reclosable bags having opposite first and second panels joined along corresponding first and second sides thereof, and a mouth having a width defined therebetween. The mouth can have a closure member extending along the mouth, the closure member including a slider configured to open and close the mouth. The method further includes staggering the positions of each slider offset along the closure member relative to the slider of each adjacent reclosable bag, rolling the stacked reclosable bags about an axis parallel with the mouth of each bag, and inserting the roll of reclosable bags into a container having a plurality of walls defining a compartment. The plurality of walls can include a bottom wall having a depth, a front wall having a height extending upwardly from the bottom wall, and a side wall having a height extending upwardly from the bottom wall and adjacent the front wall. The container can further include a cross-sectional area in side view having a linear correlation to the number of reclosable bags in the roll defined by an equation of cross-section=m(x)+b, m being about 0.17 and b being about 3.16 when x is a number of reclosable bags in the roll each having mouth widths less than about 9 inches, and m being about 0.26 and b being about 2.48 when x is a number of reclosable bags in the roll each having mouth widths greater than about 9 inches. The cross-sectional area can be in square inches.

It is to be understood that both the foregoing general description and the following detailed description are exemplary and are intended to provide further explanation of the disclosed subject matter claimed.

The accompanying drawings, which are incorporated in and constitute part of this specification, are included to illustrate, and provide a further understanding of the systems and methods of the disclosed subject matter. Together with the description, the drawings serve to explain the principles of the disclosed subject matter.

DETAILED DESCRIPTION

Figure 1:
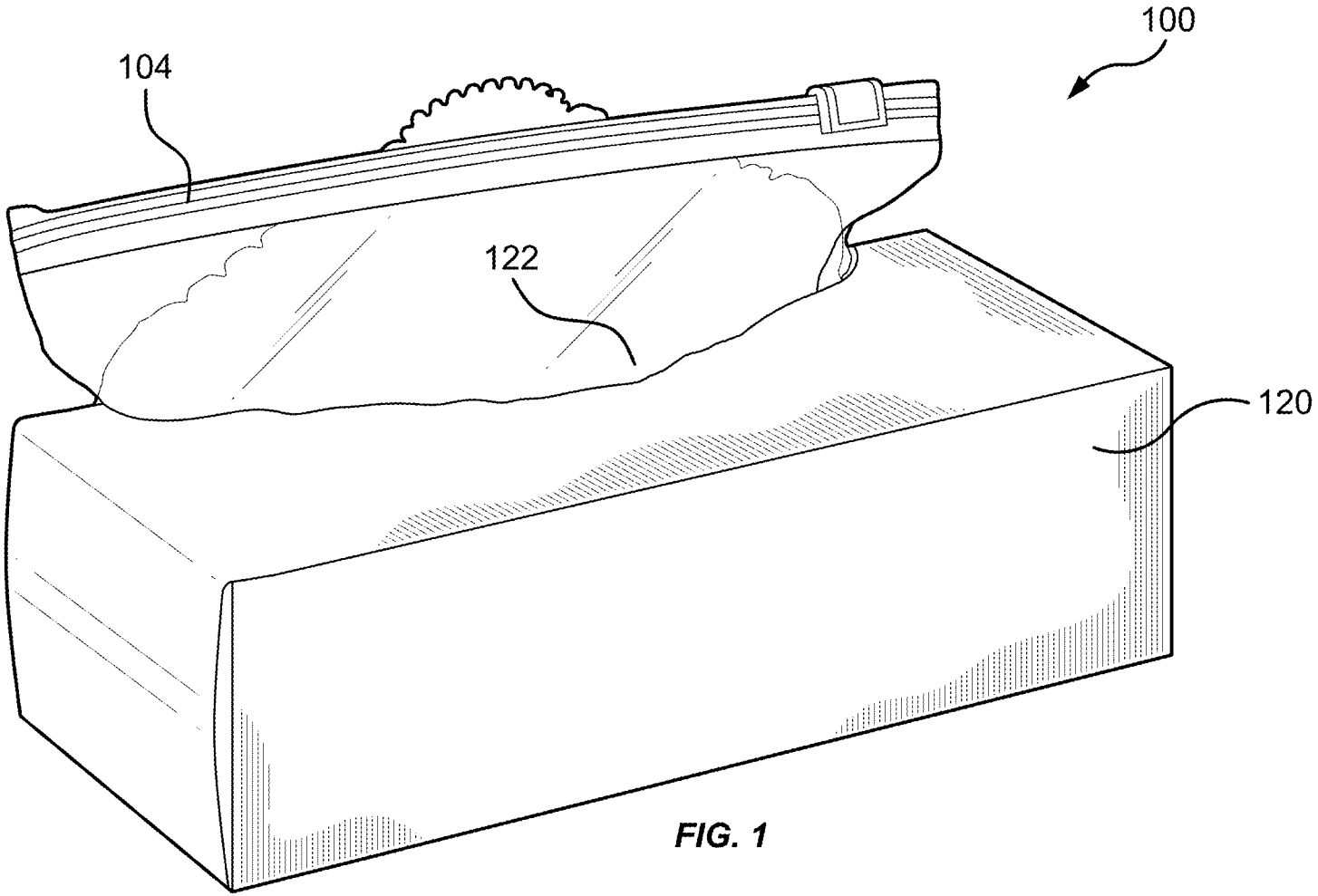
FIG. 1 is a front, left perspective view of an exemplary package in accordance with the disclosed subject matter, including an exemplary container and exemplary reclosable bags.

Reference will now be made in detail to the various exemplary embodiments of the disclosed subject matter, which are illustrated in the accompanying drawings. The structure and corresponding method of operation of the disclosed subject matter will be described in conjunction with the detailed description of the system. The accompanying drawings, where like reference numerals refer to identical or functionally similar elements throughout the separate views, serve to further illustrate various embodiments and to explain various principles and advantages all in accordance with the disclosed subject matter.

The package and methods presented herein can be used to store and dispense reclosable bags having sliders for opening and closing the bags. The positioning of the sliders during manufacturing and packaging can impact the packaging efficiency and size of the containers, which can cause increased shipping and materials costs. The package and methods of the disclosed subject matter can reduce the cross-section of the container and increase the packaging efficiency.

The accompanying figures, where like reference numerals refer to identical or functionally similar elements throughout separate views, serve to further illustrate various embodiments and to explain various principles and advantages all in accordance with the disclosed subject matter. For purpose of explanation and illustration, and not limitation, exemplary embodiments of the reclosable bags and container, as well as the various methods for packaging the reclosable bags, are shown in FIGS. 1-8.

For purpose of illustration, and not limitation, reference will be made to an exemplary embodiment of a package of reclosable bags having a container and a roll of reclosable bags therein. As used herein, the terms "front," "end," "side," "top," and "bottom" are used for the purpose of illustration only, and not limitation. That is, it is recognizable that the terms "front," "end," "side," "top," and "bottom" are interchangeable and are merely used herein as a point of reference.

The disclosed subject matter is generally directed to a package of reclosable bags having a container and a roll of reclosable bags therein. The package of reclosable bags in accordance with the disclosed subject matter generally includes a roll of reclosable storage bags. The roll having a number of x reclosable bags each having a first panel and a second panel opposite the first panel, the first panel and the second panel joined along corresponding first and second sides thereof with a mouth defined therebetween. The reclosable bags further include a closure member extending along the mouth, the closure member including a slider configured to open and close the mouth. The roll is formed by rolling the reclosable bags about an axis parallel with the mouth of each bag, and the slider of each reclosable bag in the roll is offset along the closure member relative to the slider of each adjacent reclosable bag of the roll.

The disclosed subject matter further includes a container having a plurality of walls defining a compartment. The plurality of walls includes a bottom wall having a depth, a front wall having a height extending upwardly from the bottom wall, and a side wall having a height extending upwardly from the bottom wall and adjacent the front wall. The container has a cross-sectional area in side view defined in square inches.

The cross-sectional area in side view of the container is linearly correlated with the number of reclosable bags in the roll. As described further herein, the linear correlation between the number of reclosable bags in the roll and the cross-sectional area of the container can be different for reclosable bags of different sizes. In accordance with an aspect of the disclosed subject matter, for reclosable bags having a mouth width less than about 9 inches the cross-sectional area is linearly correlated with the number of bags in the roll as defined by an equation of cross-section=m(x)+b, where m is about 0.17 and b is about 3.16. In accordance with another aspect of the disclosed subject matter, for reclosable bags having a mouth width greater than about 9 inches the cross-sectional area is linearly correlated with the number of bags in the roll as defined by an equation of cross-section=m(x)+b, where m is about 0.26 and b is about 2.48.

The disclosed subject matter further includes a method of packaging reclosable bags comprising. The method including stacking a number x of reclosable bags, staggering the positions of each slider offset along the closure member relative to the slider of each adjacent reclosable bag, rolling the stacked reclosable bags about an axis parallel with the mouth of each bag, and inserting the roll of reclosable bags into a container having a plurality of walls defining a compartment. As noted above, the container has a cross-sectional area, and the cross-sectional area of the container can be different for reclosable bags of different sizes. In accordance with an aspect of the disclosed subject matter, the cross-sectional area has a linear correlation to the number of reclosable bags in the roll defined by an equation of cross-section=m(x)+b, where x is a number of reclosable bags in the roll each having mouth widths less than about 9 inches, m is about 0.17 and b is about 3.16. In accordance with another aspect of the disclosed subject matter x is a number of reclosable bags in the roll each having mouth widths greater than about 9 inches, m is about 0.26, and b is about 2.48.

For the purpose of illustration, and not limitation, reference is made to the exemplary package 100 shown in FIG. 1-6. Additionally, for purpose of understanding, reference is made in conjunction to the linear equations depicted in the graphs in FIGS. 7 and 8, which can be used to define the linear correlation between the cross-section of the container 120 and the number of reclosable bags 104 in a roll of reclosable bags 102 that form the exemplary package 100 in FIGS. 1-6.

Figure 2:
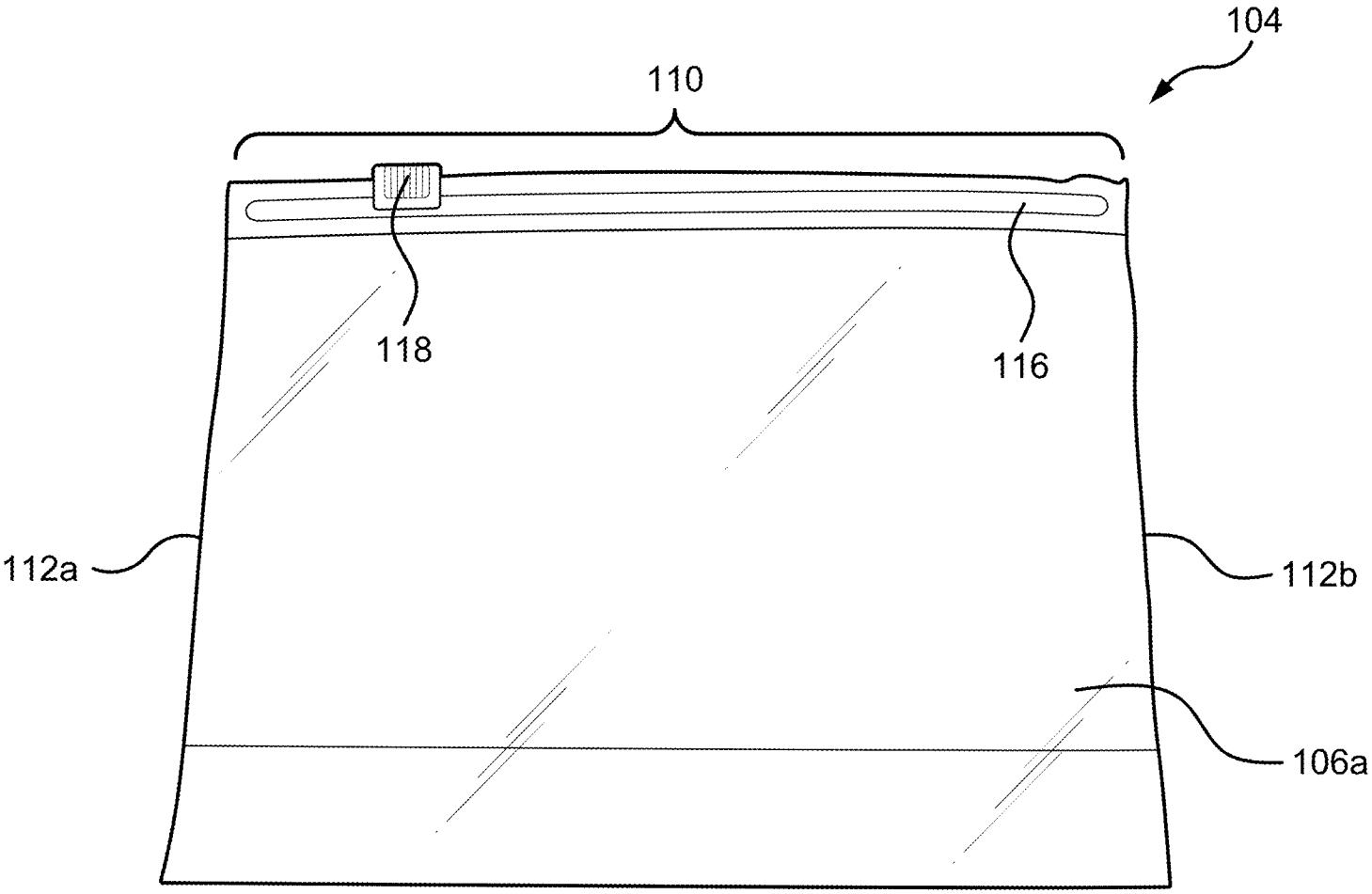
FIG. 2 is a front view of a reclosable bag of the package in FIG. 1.

With reference to FIGS. 1 and 2, the package 100 includes a container 120 configured to store a roll of x reclosable bags 102 (not shown) within a compartment 122 therein, with x representing the number of reclosable bags. Each reclosable bag 104 in the roll of reclosable bags 102 has a first panel 106*a* opposite a second panel 106*b* (not shown). The first and second panels 106*a,b* are joined along corresponding first and second sides 112*a,b* thereof. As embodied herein, the first and second panels 106*a,b* can have an overall thickness of between 0.001 inches and 0.003 inches. The reclosable bags can be made of any suitable blend of flexible resin material. For purpose of example and not limitation the reclosable bags can be made of a material including, but not limited to, polyethylene, silicone, and polypropylene. A mouth 110 is defined between the first and second sides 112*a,b* of the reclosable bag 104, the mouth 110 having a width $w_1$ in inches. As embodied herein, the width $w_1$ of the mouth 110 is less than about 9 inches. For purpose of example, and not limitation, the width w1 can be between 7.5 and 8.5 inches. Extending along the mouth 110 is a closure member 116 including a slider 118 for opening and closing the mouth 110, the slider 118 having a length/ measured along the width $w_1$ of the mouth 110.

Figure 3:
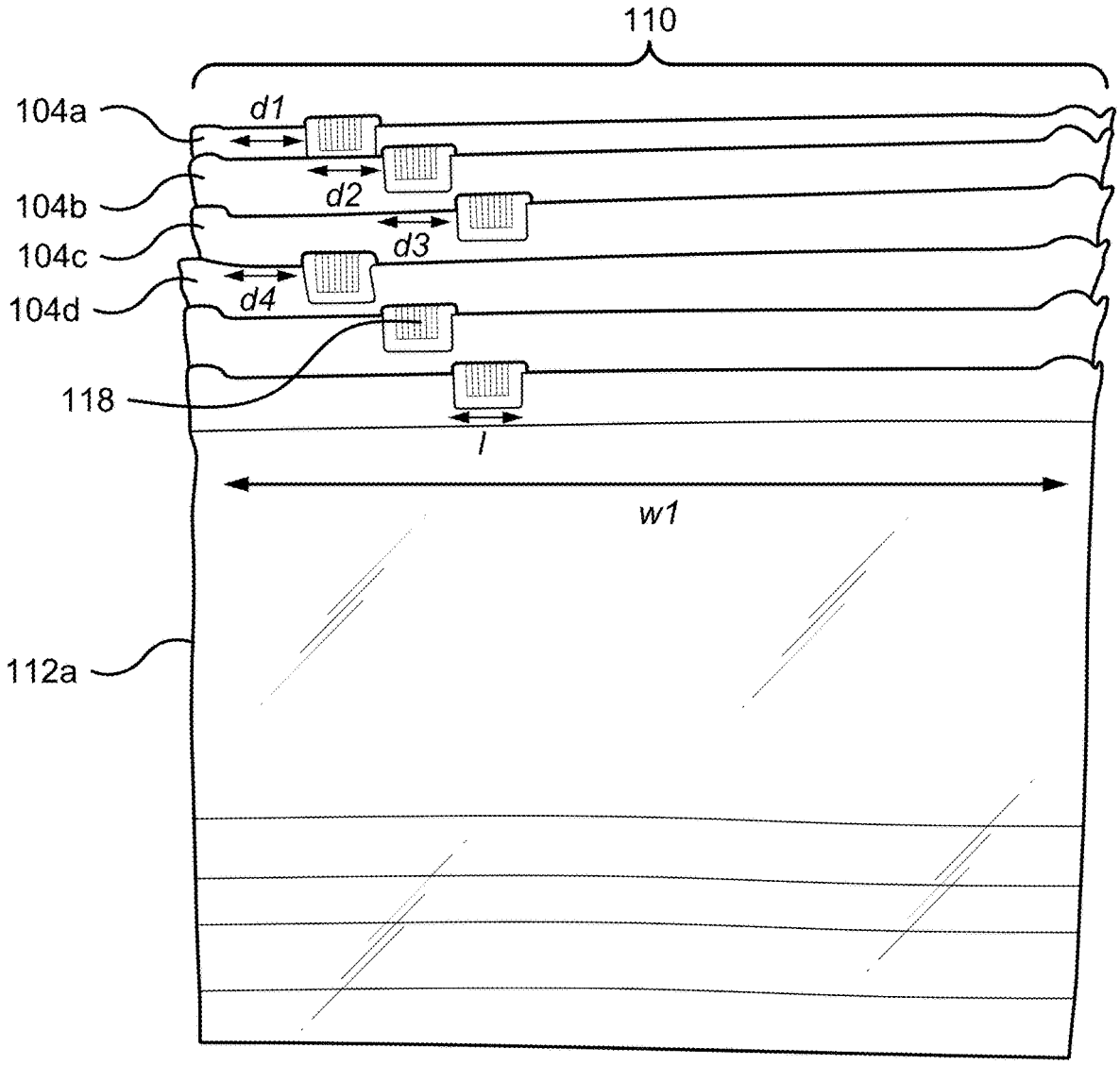
FIG. 3 is a front view of reclosable bags of the package in FIG. 1 arranged in an overlapping shingled arrangement.
Figure 4:
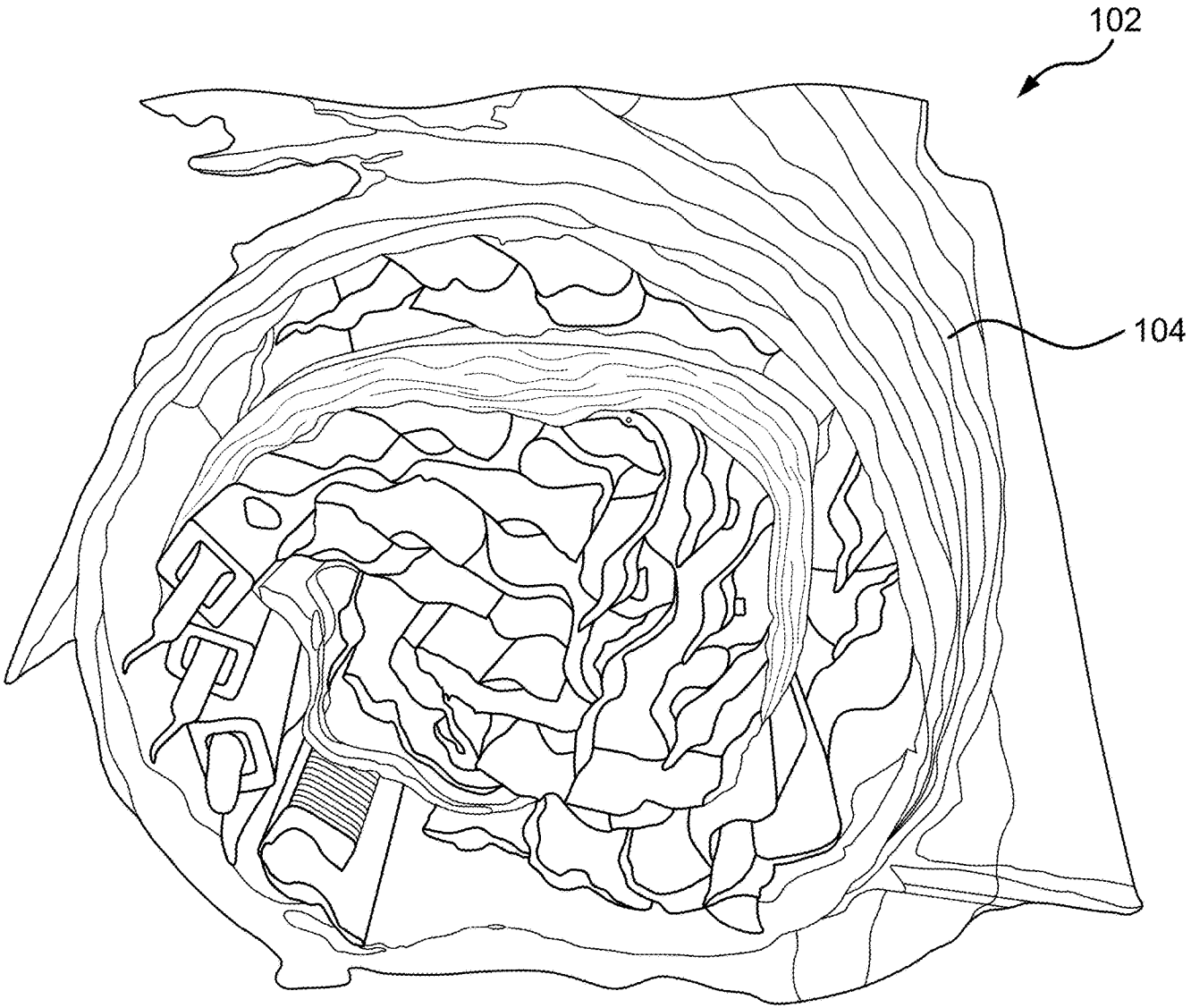
FIG. 4 is a side view of a roll of reclosable bags.

With reference to FIGS. 3 and 4, prior to rolling, the reclosable bags 104 are stacked and the slider 118 of each reclosable bag 104 is offset along its respective closure member 116 relative to the slider 118 of each adjacent reclosable bag 104. For example, the stack can include a first reclosable bag 104*a*, a second reclosable bag 104*b* adjacent the first reclosable bag 104*a*, and a third reclosable bag 104*c* adjacent the second reclosable bag 104*b*. he slider 118 of the first reclosable bag 104*a* can be spaced a first distance $d_1$ from the first side 112*a* of the first reclosable bag 104*a*. The slider 118 of the second reclosable bag 104*b* can be spaced a second distance $d_2$ from the first side 112*a* of the second reclosable bag 104*b*, the second distance $d_2$ being greater than the first distance $d_1$ by at least the slider length l. The slider 118 of the third reclosable bag 104*c* can be spaced a third distance $d_3$ from the first side 112*a* of the third reclosable bag 104*c*, the third distance $d_3$ being greater than the second distance $d_2$ by at least the slider length l.

As embodied herein, a fourth reclosable bag 104*d* can be stacked adjacent the third reclosable bag 104*c*. For example, and as embodied herein, the slider 118 of the fourth reclosable bag 104*d* can be spaced a fourth distance $d_4$ from the first side 112*a*, the fourth distance $d_4$ being equal to the first distance $d_1$, thereby creating a staggered repeating pattern. The staggered slider pattern illustrated in FIG. 3 is exemplary. Sliders can be staggered in any desirable pattern. In another example, the sliders 118 can be staggered along the entirety of the width $w_1$ of the mouth 110 before restarting the pattern on another adjacent reclosable bag 104. Those having skill in the art will appreciate that the sliders 118 can be positioned in a variety of staggered patterns without departing from the spirit or scope of the disclosed subject matter.

As illustrated in FIGS. 3 and 4, during stacking, the reclosable bags 104 can be arranged in an overlapping shingled arrangement. For example, and as embodied herein, the bags can be stacked on top of one another and arranged such that the first and second panels of adjacent bags overly one another and mouths of adjacent bags do not overly one another. As embodied herein, when the reclosable bags are rolled about an axis parallel with the mouth 110 of each bag, each adjacent reclosable bag 104 in the roll 102 can be overlapping in a shingled arrangement. As further embodied herein, the first side 112*a* of each reclosable bag 104 in the roll 102 can be aligned with the first side 112*a* of the other reclosable bags 104 of the roll 102. As embodied herein, the roll of reclosable bags 102 can have a cylindrical shape. Furthermore, the roll 102 has a number of x reclosable bags 104. In some instances, x is between 1 and 49.

Figure 5:
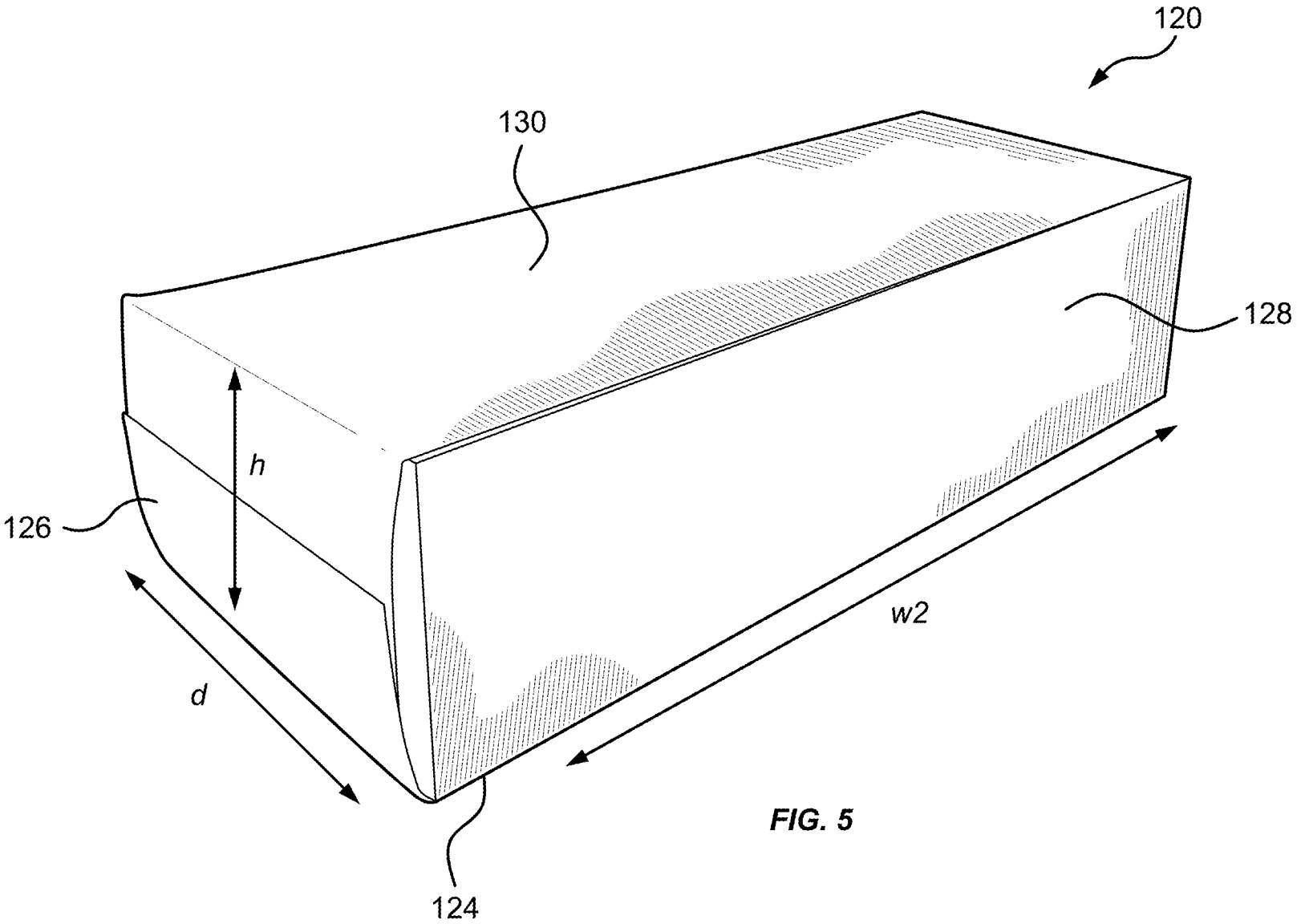
FIG. 5 is a front, left perspective view of the container of the package in FIG. 1.

With reference to FIG. 5, the container 102 of the package 100 includes a plurality of walls defining a compartment 122. The plurality of walls includes a bottom wall 124 having a depth d and a width $w_2$, a front wall 126 having a height h extending upwardly from the bottom wall 124 and a back wall (not shown) opposite the front wall 126. The plurality of walls further includes a first side wall 128 having a height extending upwardly from the bottom wall adjacent the front and back walls 126, 132, a second side wall 129 (not shown) having a height extending upwardly from the bottom wall 124 opposite the first side wall 128, and a top wall 130 having a depth opposite the bottom wall 124.

Figure 6:
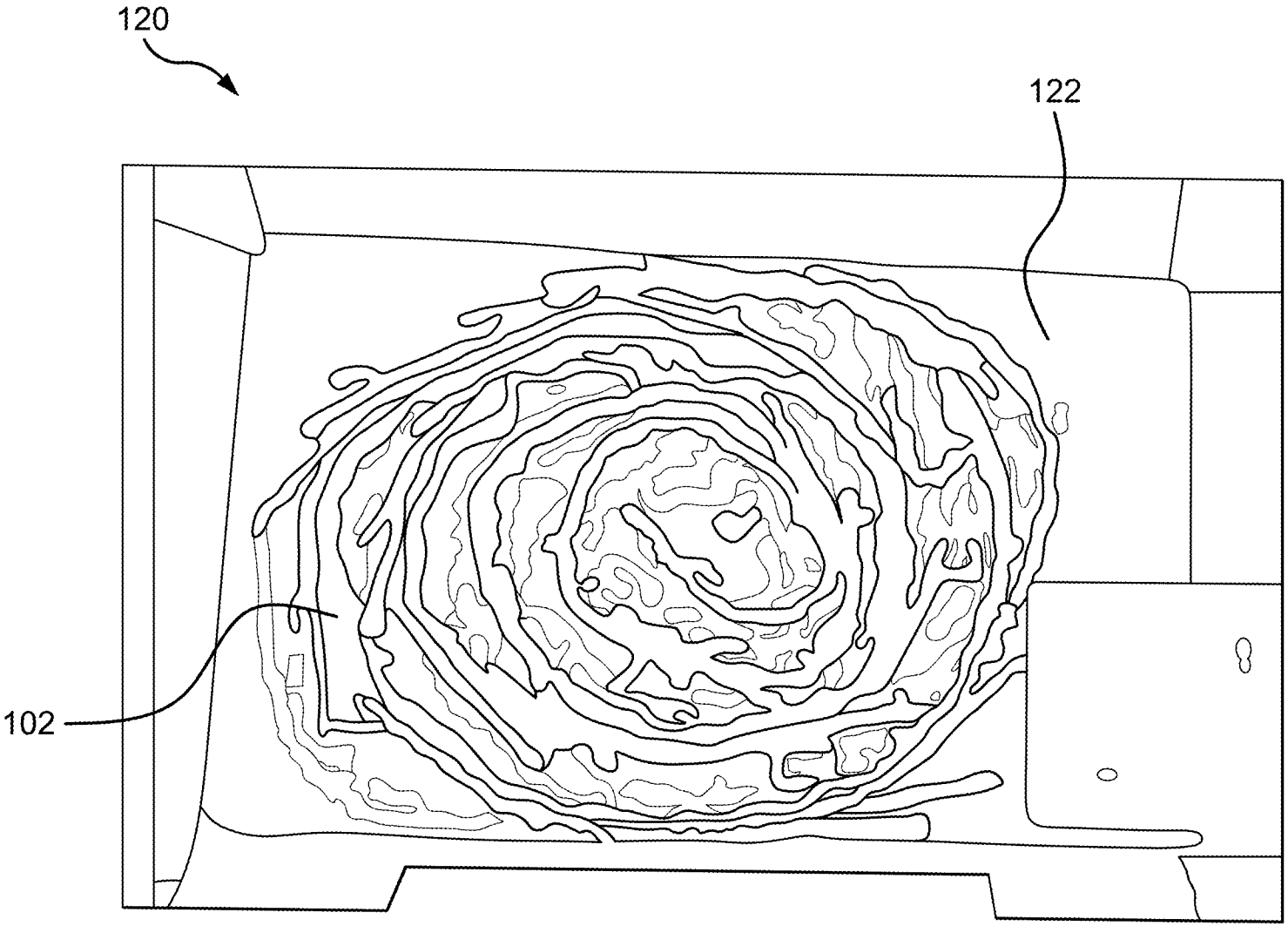
FIG. 6 is a cross-section of the side of the container in FIG. 5.
Figure 7:
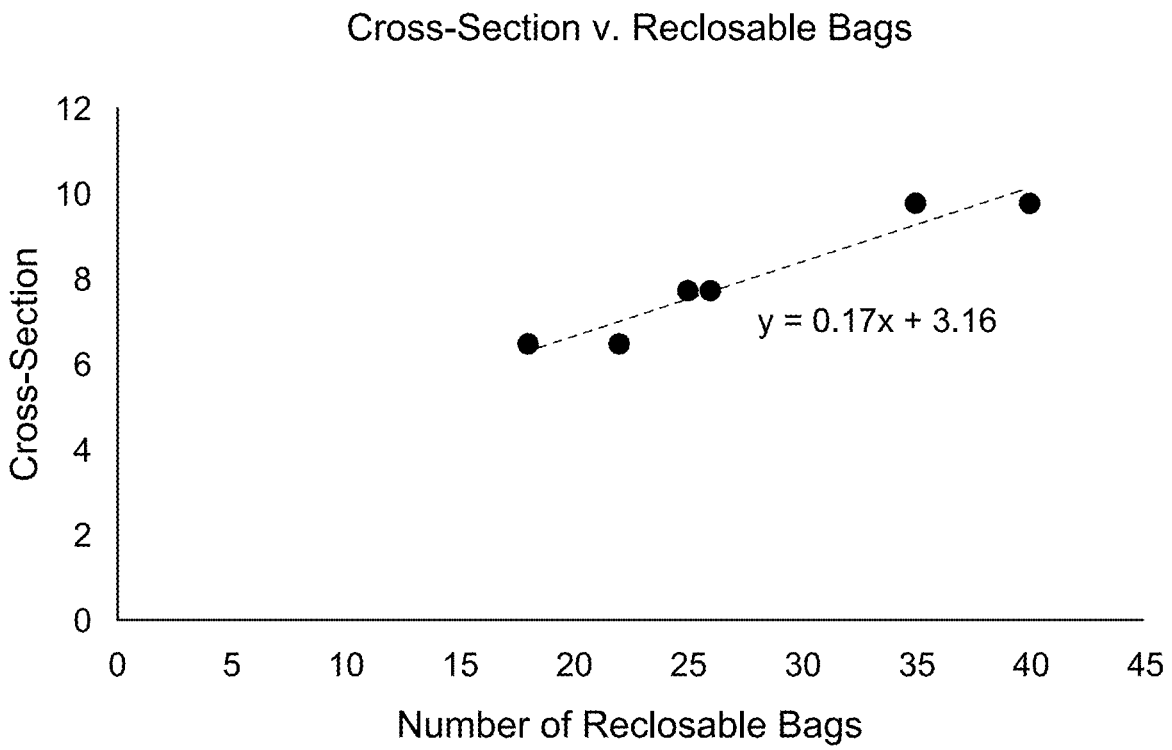
FIG. 7 is a graph illustrating the linear correlation between cross-section and reclosable bags for bags having a mouth width less than about 9 inches.
Figure 8:
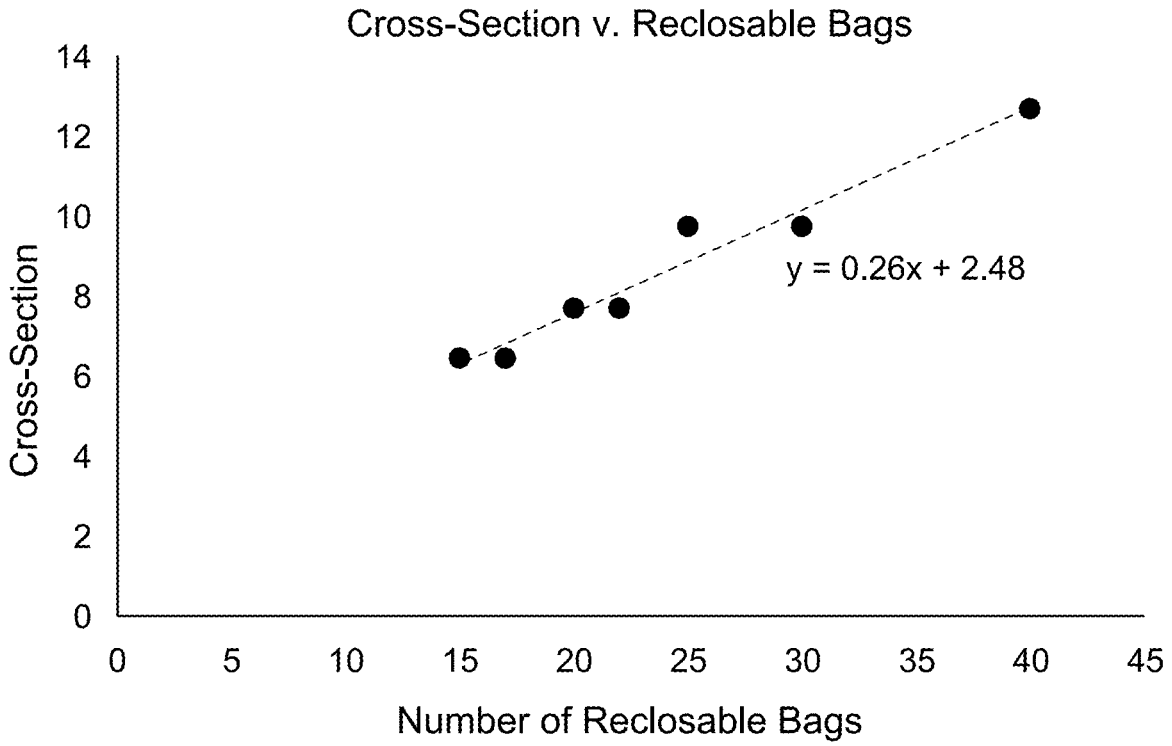
FIG. 8 is a graph illustrating the linear correlation between cross-section and reclosable bags for bags having a mouth width greater than about 9 inches.

With reference to FIGS. 6-8, the plurality of walls of the container 102 define an internal compartment 122 for storing the roll of reclosable bags 102 therein. Accordingly, the width $w_2$ of the container 120 is large enough to accommodate the width $w_1$ of the reclosable bags 104. As embodied herein, the overall width $w_2$ of the container 120 can be at least equal to but less than 10% greater than the width $w_1$ of the mouth 110 of each reclosable bag 104 of the roll 102. For example, and as embodied herein, the first side of each reclosable bag of the roll can be aligned with the first side of the other reclosable bags of the roll. As embodied herein, having the first sides of each reclosable bag of the roll aligned can reduce the overall width $w_2$ of the container 120 that can be required to accommodate the width of the roll of reclosable bags.

Furthermore, the container 102 can have a cross-sectional area in side view in square inches, as seen in FIG. 6. As embodied herein, the cross-sectional area can be calculated by multiplying the height h of the front wall 126 by the depth d of the bottom wall 124. Although the disclosed embodiments include containers having rectangular cross-sections, it is to be understood that containers having alternative configurations can be used with the disclosed subject matter and the cross-sectional area of such configurations can be calculated as is known in the art.

The cross-sectional area of the container is linearly correlated with the number of reclosable bags 104 in the roll 102. The linear correlation between the number of reclosable bags in the roll and the cross-sectional area of the container can be different for reclosable bags of different sizes. In accordance with an aspect of the disclosed subject matter, for reclosable bags having a mouth width less than about 9 inches the cross-sectional area is linearly correlated with the number of reclosable bags 104 in the roll 102 as defined by an equation of cross-section=m(x)+b, where m is about 0.17 and b is about 3.16. As used herein, m being about 0.17 means that m is between 0.15 and 0.19 and b being about 3.16 means that b is between 3.1 and 3.2. This linear correlation is depicted in FIG. 7. FIG. 7 depicts measured cross-sectional areas and reclosable bag counts for exemplary packages in accordance with the discloses subject matter. A linear trend line illustrates the linear correlation between the number of reclosable bags in the package and the cross-sectional area of the container.

According to another aspect of the disclosed subject matter, the container 120 can further include a spatial efficiency defined by a second equation of $$\frac{X}{\text{the cross-sectional area}}.$$

As with the relationship between cross-sectional area and the number of reclosable bags in the roll, the spatial efficiency of the container can be different for reclosable bags of different sizes. As embodied herein, the reclosable bags can have a mouth width less than about 9 inches, and when x is between 20 and 30 the spatial efficiency can be above 3, and when x is between 31 and 40 the spatial efficiency can be above 3.3.

Additionally, or alternatively, the reclosable bags 104 can have a mouth width $w_1$ greater than about 9 inches. For purpose of example, and not limitation, the mouth width $w_1$ can be between 9.5 and 11.5 inches. In accordance with an aspect of the disclosed subject matter, the linear correlation between the cross-section of the container 102 and the reclosable bags 104 in the roll 102 for reclosable bags having a mouth width $w_1$ greater than about 9 inches can be defined by the equation of cross-section=m(x)+b, where m is about 0.26 and b is about 2.48. As used herein, m being about 0.26 means that m is between 0.2 and 0.3 and b being about 2.48 means that b is between 2.4 and 2.5. This linear correlation is depicted in FIG. 8. FIG. 8 depicts measured cross-sectional areas and reclosable bag counts for exemplary packages in accordance with the discloses subject matter. A linear trend line illustrates the linear correlation between the number of reclosable bags in the package and the cross-sectional area of the container.

In accordance with the disclosed subject matter described above, the reclosable bags 104 can have a mouth width $w_1$ greater than about 9 inches and the container 120 can include a spatial efficiency defined by a second equation of $$\frac{X}{\text{the cross-sectional area}}.$$

The spatial efficiency is measure in bags/unit cross-section value, and when x is between 15 and 30 the spatial efficiency can be above 2.3, and when x is between 31 and 40 the spatial efficiency can be above 3.

As embodied herein, the disclosed subject matter further includes a method of packaging the reclosable bags 104. In accordance with the described subject matter above, the method includes stacking a number x of reclosable bags 104 and staggering the positions of each slider 118 located on each of the reclosable bags 104 offset along the mouth 110 of the closure member 116 relative to the slider 118 of each adjacent reclosable bag 104. The method further includes rolling the stacked reclosable bags 104 about an axis parallel with the mouth 110 of each bag 104 creating a roll of reclosable bags 102. The method also includes inserting the roll of reclosable bags 102 into a container 120.

As described above, the container 120 has a cross-sectional area that can differ for reclosable bags of different sizes. In accordance with an aspect of the disclosed subject matter, the cross-sectional area has a linear correlation to the number of reclosable bags 104 in the roll 102 defined by an equation of cross-section=m(x)+b, where x is a number of reclosable bags 104 in the roll 102 each having mouth 110 widths less than about 9 inches, m is about 0.17 and b is about 3.16. In accordance with another aspect of the disclosed subject matter x is a number of reclosable bags 104 in the roll 102 each having mouth 110 widths greater than about 9 inches, m is about 0.26, and b is about 2.48.

Example 1

For purpose of illustration and not limitation, exemplary packages of reclosable bags in accordance with the disclosed subject matter were prepared as outlined below. Each package included a roll of reclosable bags. The number of reclosable bags in each roll is denoted in Table 1 below. Each reclosable bag in the roll included a first panel and a second panel opposite the first panel, the first panel and the second panel joined along corresponding first and second sides thereof with a mouth defined therebetween, the mouth having a width less than about 9 inches. Each reclosable bag in the roll included a closure member extending along the mouth, the closure member including a slider configured to open and close the mouth. The roll was rolled about an axis parallel with the mouth of each bag. The slider of each reclosable bag in the roll was offset along the closure member relative to the slider of each adjacent reclosable bag of the roll. The exemplary packages each included a container comprising a plurality of walls defining a compartment, the plurality of walls including a bottom wall having a depth, a front wall having a height extending upwardly from the bottom wall, and a side wall having a height extending upwardly from the bottom wall and adjacent the front wall. The dimensions of the exemplary containers are included below in Table 1. Each of the exemplary containers has a cross-sectional area in side view, the cross-sectional area being linearly correlated with the number of reclosable bags in the roll defined by an equation of cross-section=m (x)+b, wherein m is about 0.17 and b is about 3.16, and wherein the cross-sectional area is in square inches. For further purposes of illustration, and not limitation, a container having a bag count of 25 and a cross-section of 7.72 square inches would be in accordance with the disclosed subject matter and the linear correlation recited above.

TABLE 1

| Bag Count | Cross-Section |
|---|---|
| 18 | 6.47 |
| 22 | 6.47 |
| 25 | 7.72 |
| 26 | 7.72 |
| 35 | 9.77 |
| 40 | 9.77 |

Example 2

For purpose of illustration and not limitation, exemplary packages of reclosable bags in accordance with the disclosed subject matter were prepared as outlined below. Each package included a roll of reclosable bags. The number of reclosable bags in each roll is denoted in Table 2 below. Each reclosable bag in the roll included a first panel and a second panel opposite the first panel, the first panel and the second panel joined along corresponding first and second sides thereof with a mouth defined therebetween, the mouth having a width greater than about 9 inches. Each reclosable bag in the roll included a closure member extending along the mouth, the closure member including a slider configured to open and close the mouth. The roll was rolled about an axis parallel with the mouth of each bag. The slider of each reclosable bag in the roll was offset along the closure member relative to the slider of each adjacent reclosable bag of the roll. The exemplary packages each included a container comprising a plurality of walls defining a compartment, the plurality of walls including a bottom wall having a depth, a front wall having a height extending upwardly from the bottom wall, and a side wall having a height extending upwardly from the bottom wall and adjacent the front wall. The dimensions of the exemplary containers are included below in Table 2. Each of the exemplary containers has a cross-sectional area in side view, the cross-sectional area being linearly correlated with the number of reclosable bags in the roll defined by an equation of cross-section=m (x)+b, wherein m is about 0.26 and b is about 2.48, and wherein the cross-sectional area is in square inches. For further purposes of illustration, and not limitation, a container having a bag count of 40 and a cross-section of 12.71 square inches would be in accordance with the disclosed subject matter and the linear correlation recited above.

TABLE 2

| Bag Count | Cross-Section |
|---|---|
| 15 | 6.47 |
| 17 | 6.47 |
| 20 | 7.72 |
| 22 | 7.72 |
| 25 | 9.77 |
| 30 | 9.77 |
| 40 | 12.72 |

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A package of reclosable bags, the package comprising:

a roll of reclosable bags, the roll comprising a number x of reclosable bags, wherein each reclosable bag has:

a first panel and a second panel opposite the first panel, the first panel and the second panel joined along corresponding first and second sides thereof with a mouth defined therebetween, the mouth having a width less than about 9 inches, and a closure member extending along the mouth, the closure member including a slider configured to open and close the mouth, wherein the reclosable bags of the roll are arranged in an overlapping shingled arrangement and the roll is rolled about an axis parallel with the mouth of each bag, and further wherein the slider of each reclosable bag in the roll is offset along the closure member relative to the slider of each adjacent reclosable bag of the roll so as to be staggered in a repeating pattern; and a container comprising a plurality of walls defining a compartment, the plurality of walls including a bottom wall having a depth, a front wall having a height extending upwardly from the bottom wall, and a side wall having a height extending upwardly from the bottom wall and adjacent the front wall, wherein the container has a cross-sectional area in side view, wherein the container has a spatial efficiency defined by an equation of $$\frac{X}{\text{the cross-sectional area}},$$

the spatial efficiency being measured in bags/unit cross-section value, wherein x is between 20 and 30 when the spatial efficiency is above 3, and wherein x is between 31 and 40 when the spatial efficiency is above 3.3.

2. The package of claim 1, wherein each slider has a slider length measured along the width of the mouth and each slider is offset along its respective closure member relative to the slider of each adjacent reclosable bag a distance greater than the slider length, and wherein the first side of each reclosable bag of the roll is aligned with the first side of each adjacent reclosable bag of the roll, and further wherein the roll of reclosable bags includes a first reclosable bag, a second reclosable bag adjacent the first reclosable bag, and a third reclosable bag adjacent the second reclosable bag, wherein the slider of the first reclosable bag is spaced a first distance from the first side of the first reclosable bag, the slider of the second reclosable bag is spaced a second distance from the first side of the second reclosable bag, and the slider of the third reclosable bag is spaced a third distance from the first side of the third reclosable bag, wherein the second distance is greater than the first distance by at least the slider length and the third distance is greater than the second distance by at least the slider length.

3. The package of claim 1, wherein the container has an overall width at least equal to but less than 10% greater than the width of the mouth of each reclosable bag of the roll.

4. The package of claim 1, wherein the mouth of each reclosable bag of the roll has a width between 7.5 and 8.5 inches.

5. A package of reclosable bags, the package comprising:

a roll of reclosable bags, the roll comprising a number x of reclosable bags, wherein each reclosable bag has:

a first panel and a second panel opposite the first panel, the first panel and the second panel joined along corresponding first and second sides thereof with a mouth defined therebetween, the mouth having a width greater than 9 inches, and a closure member extending along the mouth, the closure member including a slider configured to open and close the mouth, wherein the reclosable bags of the roll are arranged in an overlapping shingled arrangement and the roll is rolled about an axis parallel with the mouth of each bag, and further wherein the slider of each reclosable bag in the roll is offset along the closure member relative to the slider of each adjacent reclosable bag of the roll so as to be staggered in a repeating pattern; and a container comprising a plurality of walls defining a compartment, the plurality of walls including a bottom wall having a depth, a front wall having a height extending upwardly from the bottom wall, and a side wall having a height extending upwardly from the bottom wall and adjacent the front wall, wherein the container has a cross-sectional area in side view, wherein the container has a spatial efficiency defined by an equation of $$\frac{X}{\text{the cross-sectional area}},$$

the spatial efficiency being measured in bags/unit cross-section value, and wherein x is between 15 and 30, when the spatial efficiency is above 2.3, and wherein x is between 31 and 40 when the spatial efficiency is above 3.

6. The package of claim 5, wherein each slider has a slider length measured along the width of the mouth and each slider is offset along its respective closure member relative to the slider of each adjacent reclosable bag a distance greater than the slider length, and wherein the first side of each reclosable bag of the roll is aligned with the first side of each adjacent reclosable bag of the roll, and further wherein the roll of reclosable bags includes a first reclosable bag, a second reclosable bag adjacent the first reclosable bag, and a third reclosable bag adjacent the second reclosable bag, wherein the slider of the first reclosable bag is spaced a first distance from the first side of the first reclosable bag, the slider of the second reclosable bag is spaced a second distance from the first side of the second reclosable bag, and the slider of the third reclosable bag is spaced a third distance from the first side of the third reclosable bag, wherein the second distance is greater than the first distance by at least the slider length and the third distance is greater than the second distance by at least the slider length.

7. The package of claim 5, wherein the container has an overall width at least equal to but less than 10% greater than the width of the mouth of each reclosable bag of the roll.

8. The package of claim 5, wherein the mouth of each reclosable bag of the roll has a width between 9.5 and 11.5 inches.

9. A method of packaging reclosable bags comprising:

stacking a number x of reclosable bags in an overlapping shingled arrangement, each of the reclosable bags having opposite first and second panels joined along corresponding first and second sides thereof, and a mouth having a width defined therebetween, the mouth having a closure member extending along the mouth, the closure member including a slider configured to open and close the mouth;

staggering the position of each slider offset along the closure member relative to the slider of each adjacent reclosable bag to define a repeating pattern, rolling the stacked reclosable bags about an axis parallel with the mouth of each bag into a roll of reclosable bags; and inserting the roll of reclosable bags into a container having a plurality of walls defining a compartment, the plurality of walls including a bottom wall having a depth, a front wall having a height extending upwardly from the bottom wall, and a side wall having a height extending upwardly from the bottom wall and adjacent the front wall, wherein the container has a cross-sectional area in side view, wherein the container has a spatial efficiency defined by an equation of $$\frac{X}{\text{the cross-sectional area}},$$

the spatial efficiency being measured in bags/unit cross-section value, and x is between 20 and 30 when the spatial efficiency is above 3 and between 31 and 40 when the spatial efficiency is above 3.3 when the mouth width of each reclosable bag in the roll is less than about 9 inches, and further wherein x is between 15 and 30 when the spatial efficiency is above 2.3 and between 31 and 40 when the spatial efficiency is above 3 when the mouth width of each reclosable bag in the roll is greater than 9 inches.

10. The method of claim 9, wherein each slider has a slider length measured along the width of the mouth and each slider is offset along its respective closure member relative to the slider of each adjacent reclosable bag a distance greater than the slider length, and wherein the first side of each reclosable bag of the roll is aligned with the first side of each adjacent reclosable bag of the roll.

11. The method of claim 9, wherein the container has an overall width at least equal to but less than 10% greater than the width of the mouth of each reclosable bag of the roll.

12. The method of claim 9, wherein the cross-sectional area has a linear correlation to the number of reclosable bags in the roll defined by the equation 0.17x+3.16 when each reclosable bag in the roll has a mouth width less than about 9 inches, and wherein the cross-sectional area is defined by the equation 0.26x+2.48 when each reclosable bag in the roll has a mouth width greater than 9 inches, wherein each constant of each equation and the cross-sectional area is in square inches.

13. The package of claim 1, wherein the cross-sectional area has a linear correlation to the number of reclosable bags in the roll defined by an equation of cross-section=m(x)+b, wherein m is about 0.17 and b is about 3.16, and m, b, and the cross-sectional area each is in square inches.

14. The package of claim 5, wherein the cross-sectional area has a linear correlation to the number of reclosable bags in the roll defined by an equation of cross-section=m(x)+b, wherein m is about 0.26 and b is about 2.48, and wherein m, b, and the cross-sectional area each is in square inches.

15. The package of claim 2, wherein the roll of reclosable bags further includes a fourth reclosable bag adjacent the third reclosable bag, wherein the slider of the fourth reclosable bag is spaced a fourth distance from the first side of the fourth reclosable bag, the fourth distance being equal to the first distance, thereby defining the repeating pattern.

16. The package of claim 6, wherein the roll of reclosable bags further includes a fourth reclosable bag adjacent the third reclosable bag, wherein the slider of the fourth reclosable bag is spaced a fourth distance from the first side of the fourth reclosable bag, the fourth distance being equal to the first distance, thereby defining the repeating pattern.

17. The method of claim 10, wherein the repeating pattern is defined by offsetting each slider along its respective closure member relative to the slider of each adjacent reclosable bag a distance greater than the slider length and the slider length is measured along the width of the mouth, wherein the first side of each reclosable bag of the roll is aligned with the first side of each adjacent reclosable bag of the roll, and further wherein the roll of reclosable bags includes a first reclosable bag, a second reclosable bag adjacent the first reclosable bag, and a third reclosable bag adjacent the second reclosable bag, wherein the slider of the first reclosable bag is spaced a first distance from the first side of the first reclosable bag, the slider of the second reclosable bag is spaced a second distance from the first side of the second reclosable bag, and the slider of the third reclosable bag is spaced a third distance from the first side of the third reclosable bag, wherein the second distance is greater than the first distance by at least the slider length and the third distance is greater than the second distance by at least the slider length.

18. The method of claim 16, wherein the repeating pattern is further defined by a fourth reclosable bag adjacent the third reclosable bag, wherein the slider of the fourth reclosable bag is spaced a fourth distance from the first side of the fourth reclosable bag, the fourth distance being equal to the first distance.

* * * * *